US005775694A

United States Patent [19]

Jonsson

[11] Patent Number: 5,775,694

[45] Date of Patent: Jul. 7, 1998

[54] DART GAME WITH BLUNT DART HAVING MAGNET SURROUNDED BY NON-MAGNETIC SLEEVE AND BOARD INCLUDING MAGNETIC MATERIAL

[76] Inventor: Sven Jonsson, Vretavagen 3A, S-147 43, Tumba, Sweden

[21] Appl. No.: 682,774

[22] PCT Filed: Jul. 13, 1994

[86] PCT No.: PCT/SE94/00691

§ 371 Date: Sep. 20, 1996

§ 102(e) Date: Sep. 20, 1996

[87] PCT Pub. No.: WO95/21660

PCT Pub. Date: Aug. 17, 1995

[51] Int. Cl.[6] ..... A63B 65/02; F41J 3/00

[52] U.S. Cl. ..... 273/348.3

[58] Field of Search ..... 273/345, 348.3, 273/348

[56] References Cited

U.S. PATENT DOCUMENTS

| | | | |
|---|---|---|---|
| 2,683,037 | 7/1954 | Ruczynski et al. | 273/345 |
| 2,863,665 | 12/1958 | Gerosolina | 273/345 |
| 3,147,976 | 9/1964 | Millar | 273/348.3 |

*Primary Examiner*—Jessica Harrison
*Attorney, Agent, or Firm*—Limbach & Limbach L.L.P.

[57] ABSTRACT

A game of dart comprising safe darts and a board, wherein the darts are provided with blunt nose with a high-energy magnet, e.g. a neodymium magnet, surrounded by a sleeve of non-magnetic material, whereby the front end of the magnet forms the nose tip, and in that the board comprises a magnetic material and has a board picture built up by fields.

9 Claims, 2 Drawing Sheets

DART GAME WITH BLUNT DART HAVING MAGNET SURROUNDED BY NON-MAGNETIC SLEEVE AND BOARD INCLUDING MAGNETIC MATERIAL

CROSS-REFERENCE TO RELATED APPLICATION

The present application is a U.S. application claiming foreign priority benefits under 35 U.S.C. 119(a)–(d) and 35 U.S.C. 365(a)–(b) of PCT International Application No. PCT/SE94/00691 filed on Jul. 13, 1994, Swedish Patent Application 94 00504-8 filed on Feb. 11, 1994, and Swedish Patent Application 94 01776-1 filed on May 20, 1994.

1. Field of the Invention

The present invention relates to a dart game comprising safe darts and a board.

2. Description of the Prior Art

A conventional dart game consists of darts having a sharp tip which is between 20 and 30 millimeters long, and a board adapted thereto. When hitting the board the tips of the darts penetrate into the board which in the most simple embodiment consists of helically wound paper strips or straw, or, for more professional boards, of staple fibres, the board being about 30 mms thick. A common feature of known boards is that they cannot withstand damp, and therefor they are quickly destroyed when used outdoors. However, the main problem is that the sharp tips, especially in the summertime, cause many and serious eye damages. A direct hit in an eye will in most cases lead to blindness. This is emphasized by the fact that in e.g. Germany the sale of darts is prohibited to anyone under 18 years of age.

Because of the above many different solutions to the problem of providing safe darts have been suggested, but still no solution has been presented being a perfectly satisfactory substitute, not even for the most simple types of conventional dart games and even less so for the sport of darts.

There have been attempts of introducing darts with a ferritic magnet in the tip, which is intended to attach to a metal board. These require a rather great mass in order to obtain a sufficient amount of energy for obtaining the desired attraction force to the board. This type of magnet is demagnetisized by blows. This system soon disappeared because of poor function and very short time of life. Indeed, a magnetization equipment was offered in order to prolong the length of life of the darts, which however increased the costs considerably while the other drawbacks still remained.

Other solutions brought forward during the last few years are the use of Velcro tape systems with female/male part. This requires light darts, since the holding force of the Velcro system is not very strong, and at the same time the hit must be almost straight towards the board for the dart to get hooked. The hit pattern becomes difficult to read, since the hitting surface of the dart is comparatively large. Another aspect on this theme was balls with Velcro strips, where it is less important how the ball is thrown. The Velcro system, however, gets worn very quickly and this solution is not experienced as a good substitute for games using conventional darts.

Another variation on this subject is use of darts with a suction cup, wherein there is a problem with the low adhesion force; the suction cup has to be wetted; and the material is aged quickly, especially when the game is left outdoors.

One recent solution comprises a board consisting of plastic quills between which a plastic tip of a dart should wedge-in itself at a hit. Once again a straight hit is required in order to obtain said wedging in between the quills. However, the probability for the dart to hit onto a quill instead of between the quills, is great and the number of re-throws will therefor be great. The result is difficult to read, since the board consists of pins, 15 to 20 mms long, where the dart is supposed to wedge in. Experiments also show that in most cases the previous dart will fall off from the board when the next dart hits the board, and an interaction is obtained where basically one dart is exchanged for the other.

It is common for the above disclosed systems that they are not experienced as fun, and especially not by children throwing carelessly and therefore rarely getting the darts to stay on the board, and further, because the above systems cannot be used for the sport of darts.

SUMMARY OF THE INVENTION

One object of the present invention is to provide a dart game having safe darts but still making an exact reading of the hit pattern possible, and which can be used by children as well as by adults and which gives the same feeling at the throw as a conventional dart game comprising darts with steel tips.

A further object of the invention is to provide a dart game with an accuracy substantially as high as a conventional sports dart game Surprisingly, it has now been found that with a dart game according to the present invention the above problems are solved and a safe dart game is obtained, which is also well adapted for competition purposes.

The invention is characterized in that the darts are provided with a blunt nose with a high-energy magnet, e.g. a neodymium magnet, surrounded by a non-magnetic material, whereby the front end of the magnet forms the nose tip, and in that the board comprises a magnetic material and has a board picture built up of fields.

A high-energy magnet has an energy content per mass unit which is at least 20 times as high as in a ferrite magnet. A neodymium magnet is not demagnetized by blows. With the arrangement with a sleeve of non-magnetic material surrounding the high energy magnet the dart is drawn to a position perpendicular to the board, independent of the hitting angle and the form of the nose tip. This means that even with an uncontrolled throw the dart still adheres to the board.

DESCRIPTION OF PREFERRED EMBODIMENTS OF THE INVENTION

Further objects, features and advantages of the invention will be evident from the following description of a number of embodiments and developments of the invention.

Figure 3:
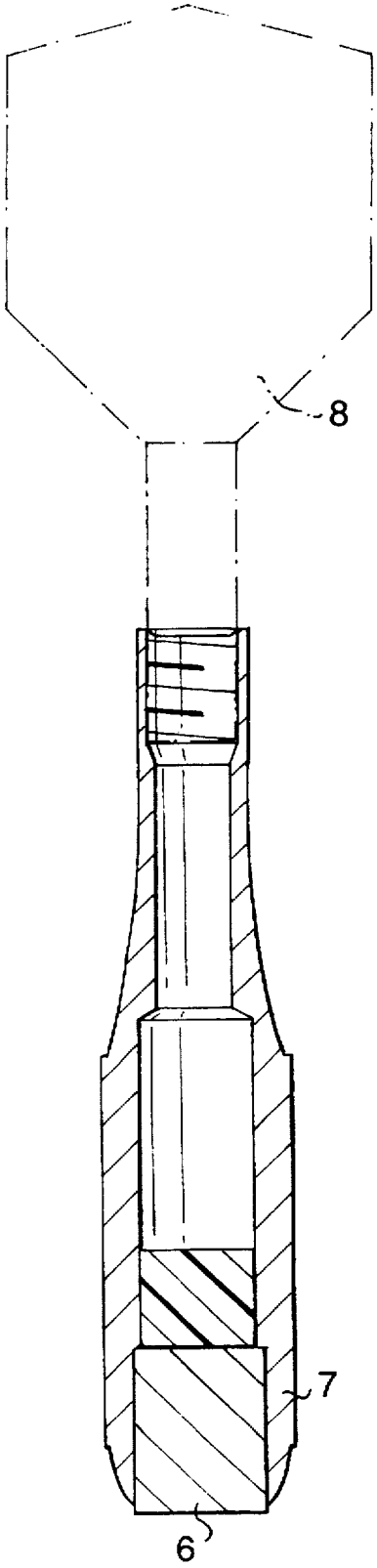
FIG. 3 is a simplified cross-sectional view of a dart in accordance with the invention.

A conventional dart as well as the dart according to the invention has a nose tip and a steering-end (e.g., steering-end 8 of FIG. 3). In the dart game according to the invention the nose with the needleformed point of a conventional dart has been substituted with a blunt nose, in which a high-energy magnet (e.g., magnet 6 of FIG. 3) is set in a sleeve consisting of a non-magnetic material (e.g., sleeve 7 of FIG. 3). This sleeve may be of plastic, in which case the complete dart can be cast in plastic, or it could be a sleeve made of aluminium, brass, tin, zinc, etc. If the dart is manufactured completely in plastic the weight of the dart can be optimized by casting-in suitable pieces of material increasing the weight of the dart.

Even if the dart hits the board sideways with a rounded tip the dart will automatically rise since the magnet strives to find the shortest way to the magnetic material.

One end of the high-energy magnet preferably forms the tip of the dart. All darts should have the magnets oriented in the same direction so that they do not repel each other. In order to magnify the magnetic force, an intervening sleeve of magnetic material can be mounted between the high-energy magnet and the outer sleeve to bring forward the pole turned from the nose, whereby the force is magnified when the board short-circuits the poles. It is also possible to use a magnet separated into two with the parts in parallel with the north and south poles, respectively, turned towards the nose. The board will then achieve short-circuiting and thereby increase the effect. The magnet can also be divided into segments. These solutions, however, will be more expensive compared to increasing the size of the magnet and orienting the magnet to have only one pole in contact with the board.

It has been found that a cylindrical bar magnet with the dimensions 6×6 mms with only one pole in contact with the board gives a completely satisfactory magnetic force against the board.

For full use of the magnetic force and with no field at the back of the board, a board thickness of 0.5 mm is sufficient for the size of the magnet discussed above. A thicker board can be suitable for other reasons.

Figure 1:
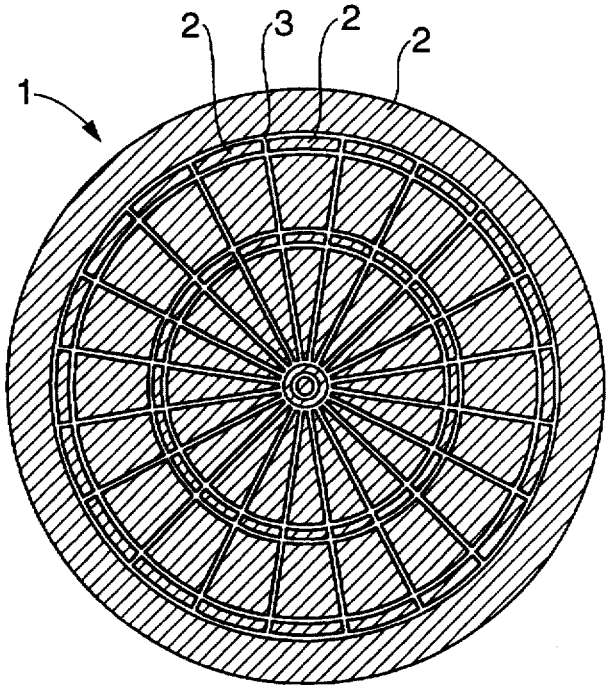
FIG. 1 is an elevational view of a board for darts according to the invention, comprising pieces of magnetic material arranged with spacings therebetween.

In order to obtain a high precision, e.g. for dart competition, according to a preferred embodiment of the present invention the board is made with fields (each field composed of a piece of magnetic material, such as any of pieces 2 of FIG. 1) such that the magnetic attractive force between the dart and spaces between the fields (e.g., space 3 between pieces 2 of FIG. 1) is lower than that between the dart and any of the field areas. The spaces between the fields form bands with lower magnetic attraction force, which means that a dart hitting in the area of a band will be pulled to the field lying closest to the point of the hit. For this reason an analysis of the hit pattern will be simple and secure while at the same time the risk for the dart to bounce back or slide between fields is minimized. A suitable band width can be for example 2 to 10 mms, advantageously 4 to 8 mms, depending on the diameter of the dart tip and the attraction force of the magnet.

The provision of areas of lower magnetic attraction force is preferably achieved by the board being built up by separate pieces of magnetic material (e.g., pieces 2 of board 1 of FIG. 1 or pieces 2 of board 10 of FIG. 2) formed according to the form of the individual fields. The pieces of magnetic material (e.g., metal) whose forms correspond to the different fields are connected with a foil (not shown in the Figures) showing the picture of the board in such a way that the non-magnetic bands mentioned above are formed between the fields. The separate pieces of metal can be punched out of a plate and then mounted simultaneously, such as from a magazine. Tests performed with a board comprising separate fields with spacings without any magnetic attraction force show that even higher precision than with a conventional dart game can be achieved. The tests demonstrate that when a dart hits 0.1 mm closer to one of two fields, the dart is pulled to the closest field, and bouncing-off seldom occurs. In contrast to this the wires making up the field boundaries used with conventional dart boards have a diameter of about 1 to 1.2 mms, which also corresponds to the dissolution, and further, the dart will fall off the board when hitting the wire.

Figure 2:
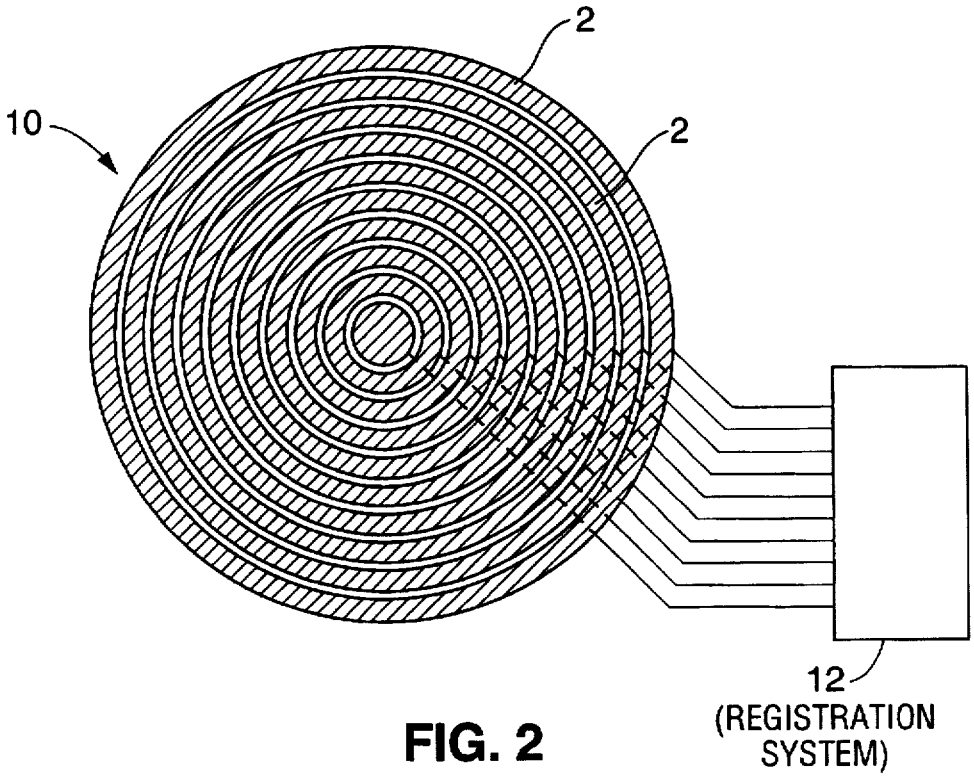
FIG. 2 is an elevational view of a board for darts according to another embodiment of the invention, comprising pieces of magnetic material arranged with spacings therebetween.

Although the invention is illustrated with reference mainly to competitive darts, of course any board picture and the corresponding division into separate pieces of magnetic material can be used, e.g. a board with 10 rings for target throwing (such as board 10 shown in FIG. 2).

According to a further embodiment of the invention, by arranging the magnet to be slightly movable sideways it is possible to achieve that the movement of the dart sideways immediately before hitting the board is facilitated in that firstly, only the magnet is moved due to the magnetic attraction force. The magnet can be spring biased to a "resting" position or it can simply be arranged with a clearance, for example on the order of parts of a millimeter.

A further advantage obtained with separate metal pieces forming each individual field is that a weakened acoustic signal appears, i.e. a higher acoustic attenuation is obtained, while at the same time sliding of a dart between two fields is out of the question.

According to a further development of the embodiment of the invention wherein the magnetic material of the board is divided into individual pieces with shape corresponding to the fields of the board in question, each piece is provided with or connected to a means for registration of a hit and for giving a corresponding electric signal intended to be the cause of a message on e.g. a display. Such registration means (e.g., registration system 16 connected to pieces 2 of board 10 of FIG. 2) are well known to those skilled in the art and can for example be coils on printed circuits, which sense the magnetic field and emit a signal upon changes; Hall transmitters which sense changes in the board and emit an electric signal; microphones; accelerometers; or pressure sensors.

A printed decal is advantageously put onto the board, which decal can be manufactured from plastic with an adhesive easy to remove. Hereby a damping to a certain extent of the hit of the dart against the board is obtained, which means that bouncing-off upon hard hits becomes less frequent. Further, the decal can be changed when it has been damaged by darts after a longer time of use. The costs for changing the decal is very low compared to the costs for changing the whole board.

Advantageously, a viscoelastic foil or a foil with a backing plate of thinner material for acoustic attenuation is put onto the backside of the board. Advantageously this acoustically attenuating material is mounted on the backside of the board, since otherwise the contact distance between magnet and board is increased and then a stronger magnet would be needed with an accompanying cost increase.

In view of the above it is possible to offer satisfactory possibilities of practising the sport of darts in a pub environment, where use of conventional darts is unsuitable unless there are well restricted areas for the courses. Otherwise, other guests can easily find themselves between the one throwing darts and the board with a risk of nasty accidents. If a dart according to the invention hits an eye the consequences are substantially less serious than if a conventional steel tip hits the eye. The risk of being hurt if a dart according to the invention hits the body, is very small.

With the dart game according to the invention a game is obtained which is suitable for use indoors too, for example for a children's party where it is completely out of the question to use a conventional dart game.

In order to minimize the risk that a dart slides in a slanting hit, according to a further embodiment the nose of the dart can be provided with a high friction coating, which can be achieved by for example dipping the nose in a rubber solution so that the tip has a thin layer of rubber in order to provide more friction against the printed decal. Hereby the dart stops when it hits the board and stands perpendicularly out from the board. However, this is hardly necessary when the board comprises magnetic material in the form of individual metal pieces with bands of non-magnetic material between the metal pieces, which bands form field boundaries. Of course the board could be coated with a layer increasing the friction.

The darts are preferably formed in such a way that the magnets have the same direction in each dart. With this feature the darts will not repel each other, making possible hits very close to each other without the darts being drawn towards each other, since each magnet is short-circuited against the board and does not have the power to repel the other dart.

According to a development of the invention the board is designed for the sport of darts with enlarged fields, which also cover the area on a conventional dart board wherein numbers are placed. Thereby the larger target area of the darts are compensated for, and e.g. all darts can also in this case be accommodated in "bulls eye".

The dart game according to the invention is very economical from a manufacturing point of view and also regarding transport and storage it is very advantageous, since it only has to be a few mms thick and can be piled. This should be compared with conventional boards which are between 20 and 40 mms thick. The darts are packed separately and take up the same amount of space as normal darts. However, less demands are put on the packages since there are no sharp tips.

What is claimed is:

1. A dart game comprising safe darts and a board, wherein each of the darts has a blunt nose comprising a high-energy magnet surrounded by a sleeve of non-magnetic material, and wherein the board comprises fields of a magnetic material, the magnet exerts a magnetic attraction force on each of the fields when the nose approaches said each of the fields, the fields are surrounded by boundaries forming non-magnetic bands, whereby the magnet exerts less magnetic force on any one of the bands than on any of the fields adjacent to said any one of the bands, and each of the bands has a width such that when any one of the darts hits said any one of the bands at a location closer to a first one of the fields than to each other one of the fields, said any one of the darts is pulled magnetically to said first one of the fields and adheres to said first one of the fields.

2. A dart game according to claim 1, wherein said fields are individual pieces of the magnetic material, and said bands are spacings between the pieces.

3. A dart game according to claim 1 or 2, wherein each of the bands has width in a range between 2 mm and 10 mm.

4. A dart game according to claim 1, wherein the magnet is spring biased and movable in the nose of the dart.

5. A dart game according to claim 2, wherein each of the pieces is provided with or connected to a means for registration of a hit by the dart.

6. The dart game of claim 1, wherein the high-energy magnet is a neodymium magnet.

7. The dart game of claim 3, wherein said each of the bands has width in a range between 4 mm and 8 mm.

8. The dart game of claim 1, wherein the sleeve comprises high friction material.

9. A dart board, for use with a safe dart having a blunt nose comprising a high-energy magnet surrounded by a sleeve of non-magnetic material, said board comprising:

fields of a magnetic material selected so that the magnet exerts a magnetic attraction force on each of the fields when the nose of the dart approaches said each of the fields; and non-magnetic bands surrounding the fields, each of the bands being composed of a non-magnetic material selected so that the magnet exerts less magnetic attraction force on said each of the bands than on any of the fields adjacent to said each of the bands when the nose approaches the board, said each of the bands having a width such that when the dart hits any one of the bands at a location closer to a first one of the fields than to each other one of the fields, said dart is pulled magnetically to said first one of the fields and adheres to said first one of the fields.

* * * * *

UNITED STATES PATENT AND TRADEMARK OFFICE

CERTIFICATE OF CORRECTION

PATENT NO.: 5,775,694
DATED: July 7, 1998
INVENTOR(S): SVEN JONSSON

It is certified that an error appears in the above-identified patent and that said Letters Patent is hereby corrected as shown below:

Please add the following text to the title page of the patent:

--[30] Foreign Application Priority Data:

| | | |
|---|---|---|
| February 11, 1994 | SWEDEN | 94 00504-8 |
| May 20, 1994 | SWEDEN | 94 01776-1 -- |

Signed and Sealed this

Twentieth Day of October, 1998

*Attest:*

*Attesting Officer*

BRUCE LEHMAN

*Commissioner of Patents and Trademarks*